US009583835B2

(12) United States Patent
Lin

(10) Patent No.: US 9,583,835 B2
(45) Date of Patent: Feb. 28, 2017

(54) MULTIBAND ANTENNA AND WIRELESS COMMUNICATION DEVICE EMPLOYING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 215 days.

(21) Appl. No.: 14/011,912

(22) Filed: Aug. 28, 2013

(65) Prior Publication Data

US 2014/0111381 A1 Apr. 24, 2014

(30) Foreign Application Priority Data

Oct. 19, 2012 (TW) ..... 101138631 A

(51) Int. Cl.

| | |
|---|---|
| ***H01Q 5/00*** | (2015.01) |
| ***H01Q 9/04*** | (2006.01) |
| ***H01Q 5/357*** | (2015.01) |
| ***H01Q 5/378*** | (2015.01) |

(52) U.S. Cl.

CPC ..... *H01Q 9/04* (2013.01); *H01Q 5/357* (2015.01); *H01Q 5/378* (2015.01); *H01Q 9/0407* (2013.01)

(58) Field of Classification Search

CPC ..... H01Q 1/243; H01Q 5/378; H01Q 5/385; H01Q 1/24; H01Q 1/241; H01Q 5/392; H01Q 5/40; H01Q 9/04; H01Q 9/0407

USPC ..... 343/702

See application file for complete search history.

(56) References Cited

U.S. PATENT DOCUMENTS

| | | | | |
|---|---|---|---|---|
| 5,517,676 | A * | 5/1996 | Sekine et al. | 455/575.5 |
| 6,686,886 | B2 * | 2/2004 | Flint | H01Q 1/22 343/700 MS |
| 6,985,108 | B2 * | 1/2006 | Mikkola | H01Q 1/243 343/700 MS |
| 7,764,238 | B2 * | 7/2010 | Hotta | H01Q 1/2266 343/700 MS |
| 8,547,283 | B2 * | 10/2013 | Wong et al. | 343/702 |
| 2011/0133995 | A1 * | 6/2011 | Pascolini | H01Q 7/00 343/702 |
| 2012/0001815 | A1 * | 1/2012 | Wong | H01Q 1/243 343/749 |

* cited by examiner

*Primary Examiner* — Sue A Purvis
*Assistant Examiner* — Patrick Holecek
(74) *Attorney, Agent, or Firm* — Zhigang Ma

(57) ABSTRACT

A multiband antenna includes a radiating portion, a grounding portion, a metal member, and a resonating portion. The radiating portion receives feed signals. The grounding portion is grounded. The metal member connects to the radiating portion and the grounding portion, and defines a slit that is adjacent to the radiating portion and the grounding portion. The resonating portion is positioned in an area surrounded by the radiating portion, the grounding portion, and the metal member. The resonating portion resonates with the radiating portion and the metal member to enable the multiband antenna to receive and send wireless signals at different frequencies.

17 Claims, 7 Drawing Sheets

MULTIBAND ANTENNA AND WIRELESS COMMUNICATION DEVICE EMPLOYING SAME

BACKGROUND

1. Technical Field

The exemplary disclosure generally relates to antennas, and particularly to a multiband antenna and a wireless communication device employing the multiband antenna.

2. Description of Related Art

Antennas are important elements of wireless communication devices (such as mobile phones). A portable electronic device may receive/send wireless signals of different frequencies, requiring the presence of a multiband antenna. A typical multiband antenna has a switch circuit, which includes a plurality of capacitors, a plurality of inductors, and one or more switches. A working frequency of the multiband antenna is regulated by the switches. Therefore, the aforementioned multiband antenna tends to be large with a complicated structure, compromising efforts toward miniaturization of portable electronic devices.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
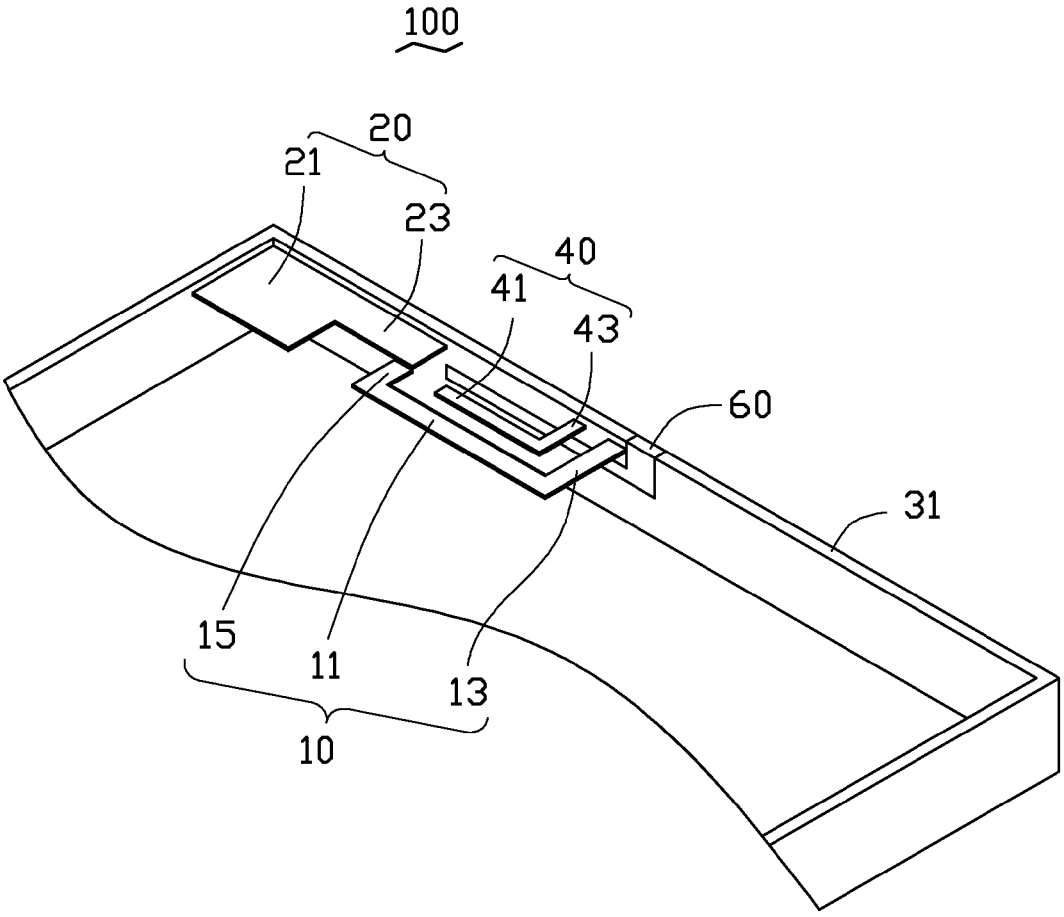
FIG. 1 is a schematic view of a multiband antenna, according to a first exemplary embodiment.
Figure 2:
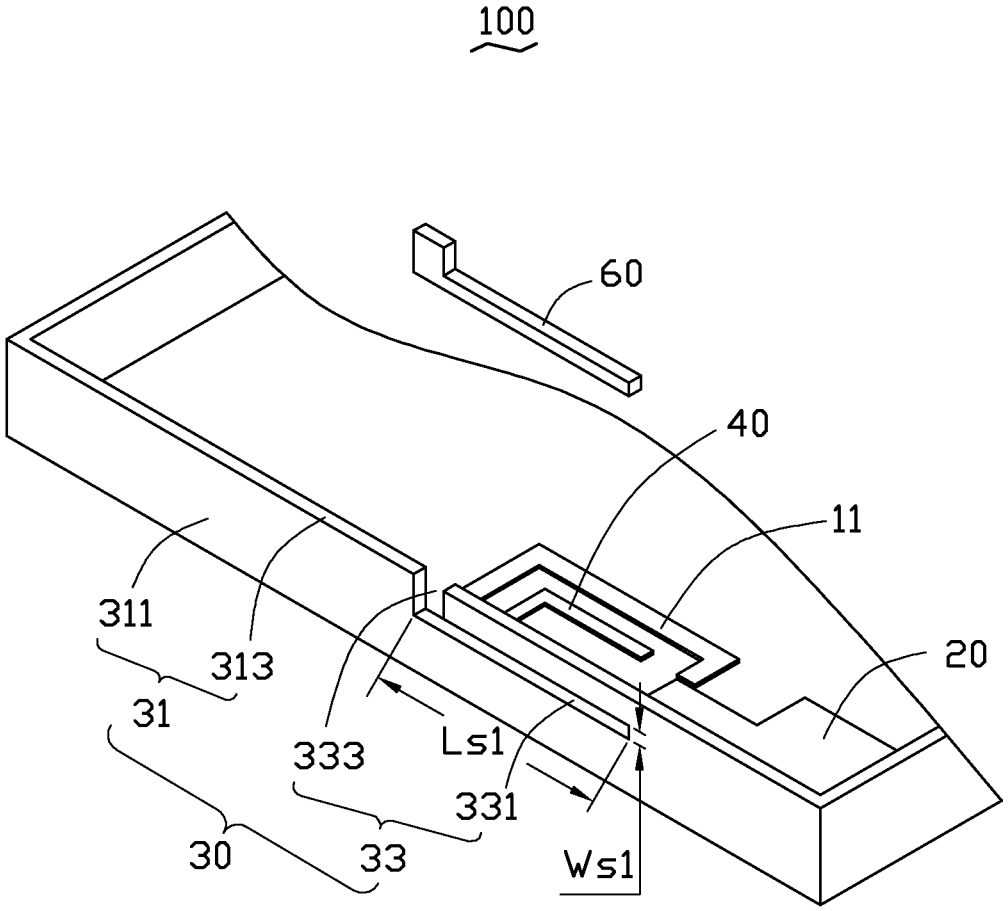
FIG. 2 is similar to FIG. 1, but showing the multiband antenna in a second configuration.

FIG. 1 is a schematic view of a multiband antenna 100, according to a first exemplary embodiment. FIG. 2 is similar to FIG. 1, but showing the multiband antenna 100 in a second configuration. The multiband antenna 100 is used in a wireless communication device, such as a mobile phone, a personal digital assistant (PDA), or a tablet computer, for example. The multiband antenna 100 includes a radiating portion 10, a grounding portion 20, a metal member 30, and a resonating portion 40. The radiating portion 10, the grounding portion 20, and the resonating portion 40 are positioned in a same plane in an antenna holder (not shown).

The radiating portion 10 includes a first radiating arm 11, a second radiating arm 13 extending from one end of the first radiating arm 11, and a third radiating arm 15 extending from another end of the first radiating arm 11. The first radiating arm 11 is substantially rectangular. The second and the third radiating arms 13 and 15 are positioned at a same side of the first radiating arm 11. The second radiating arm 13 is substantially parallel to the third radiating arm 15, and is longer than the third radiating arm 15. A distal end of the second radiating arm 13 connects with the metal member 30. A distal end of the third radiating arm 15 is electronically connected to a motherboard (not shown) of the wireless communication device via a feed cable, such that the distal end of the third radiating arm 15 serves as a feed point to feed signals.

The grounding portion 20 is grounded via the motherboard of the wireless communication device, and is positioned at a side of the third radiating arm 15 away from the second radiating arm 13. The grounding portion 20 contacts the metal member 30, thereby electronically connecting to the metal member 30. The grounding portion 20 is a substantially L-shaped planar sheet, and includes a main section 21 and an extension section 23. The main section 21 is a substantially rectangular sheet. A distal end of the extension section 23 is positioned between the third radiating arm 15 and the metal member 30.

The metal member 30 includes a side wall 31 and an L-shaped slit 33 (shown in FIG. 2) defined through the side wall 31. The slit 33 includes a first sub-slit 331 and a second sub-slit 333 communicating with and perpendicular to the first sub-slit 331. The first sub-slit 331 is parallel to the first radiating arm 11, and the second sub-slit 331 is perpendicular to a plane in which the radiating portion 10 is positioned. In the exemplary embodiment, the side wall 31 includes two side surfaces 311 and an top surface 313 connected between the two side surfaces 311. The first sub-slit 331 is defined through the two side surfaces 311, and extends along the top surface 313. The second sub-slit 333 is defined through the two side surfaces 311 and the top surface 313. A distal end of the second radiating arm 13 contacts with the metal member 30, and is positioned adjacent to the second sub-slit 333. The radiating portion 10, the grounding portion 20, and the first sub-slit 331 are positioned at the same side of the second sub-slit 333.

The resonating portion 40 is substantially L-shaped, and is coplanar with the radiating portion 10 and the grounding portion 20. The resonating portion 40 is spaced apart from the radiating portion 10, and is positioned in an area surrounded by the radiating portion 10, the grounding portion 20, and the metal member 30. In particular, the resonating portion 40 includes a fourth radiating arm 41 and a fifth radiating arm 43 perpendicular to the fourth radiating arm 41. The fourth radiating arm 41 is shorter than and parallel to the first radiating arm 11. The fifth radiating arm 43 is shorter than and parallel to the second radiating arm 13. A distal end of the fifth radiating arm 43 contacts with the metal member 30, thereby establishing an electric connection between the resonating portion 40 and the metal member 30.

The radiating portion 10, the grounding portion 20, and the metal member 30 having the slit 33 cooperate to form a loop antenna. In addition, the resonating portion 40 is surrounded by the radiating portion 10, the grounding portion 20, and the slit 33, and is electrically connected to the metal member 30, such that the resonating portion 40, the radiating portion 10, and the metal member 30 cooperate to form an L-type Loop antenna. In use, current signals transmitted to the third radiating arm 15 are transmitted to the radiating portion 10, the resonating portion 40, and the metal member 30 having the slit 33 of the metal member 30 to form a plurality of current paths of different lengths. Thus, the aforementioned loop antenna and L-type Loop antenna are enabled to serve as antenna members for receiving and sending wireless signals at different frequencies. In the exemplary embodiment, the multiband antenna 100 receives and sends wireless signals at frequencies of about 2.4 GHz and about 5 GHz.

The multiband antenna 100 further includes a dielectric member 60. The dielectric member 60 has a same shape and size as the slit 33. In the exemplary embodiment, the metal member 30 is a portion of a housing of the wireless communication device. The dielectric member 60 may fill in the slit 33 of the metal member 30 to improve the aesthetics of the wireless communication device. The dielectric member 60 can be made of plastic material, for example.

Figure 3:
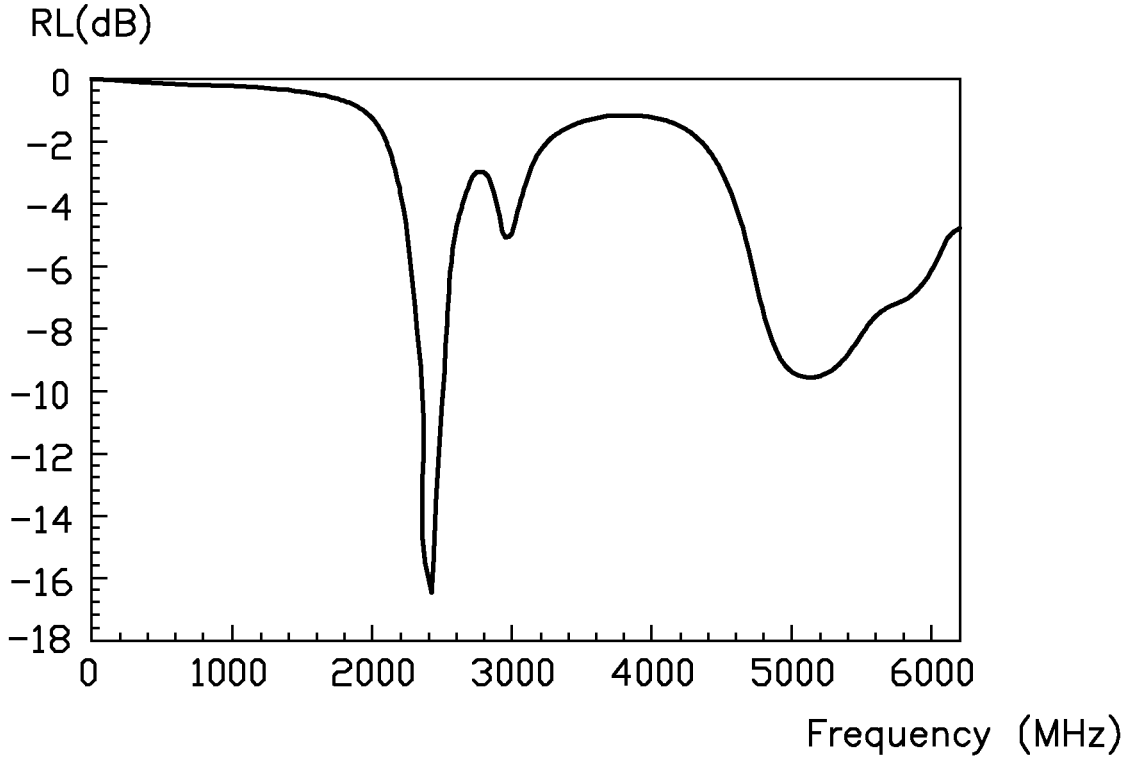
FIG. 3 is an RL (return loss) diagram of the multiband antenna of FIG. 1.

FIG. 3 is an RL diagram of the multiband antenna 100 shown in FIG. 1. The RL of the multiband antenna 100 is less than −6 dB when the multiband antenna 100 receives/sends wireless signals at frequencies of about 2.4 GHz and 5 GHz. Accordingly, the wireless communication device employing the multiband antenna 100 can be used in a plurality of common wireless communication systems, such as 2.4G-Bluetooth/WiFi and 5G-WiFi, with acceptable communication quality.

Figure 4:
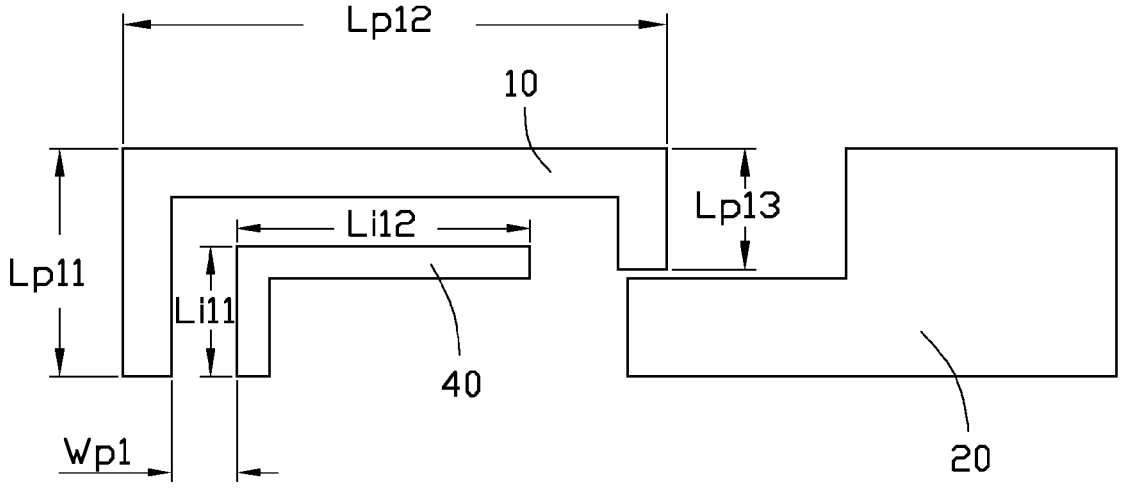
FIG. 4 is a plan view of a radiating portion, a resonating portion, and a grounding portion of the multiband antenna shown in FIG. 1.

FIG. 4 is a plan view of the radiating portion 10, the resonating portion 40, and the grounding portion 20 of the multiband antenna 100 shown in FIG. 1. A length of the first sub-slit 331 is set as Ls1 (shown in FIG. 2), a width of the first sub-slit 331 is set as Ws1 (shown in FIG. 2), a length of the radiating portion 10 (that is a sum of a length Lp11 of an outer margin of the second radiating arm 13, a length Lp12 of an outer margin of the first radiating arm 11, and a length Lp13 of an outer margin of the third radiating arm 15) is set as Lp1 (not shown), a distance between the second radiating arm 13 and the fifth radiating arm 43 is set as Wp1, a length of the resonating portion 40 (that is a sum of a length Li11 of an outer margin of the fifth radiating arm 43 and a length Li12 of an outer margin of the fourth radiating arm 41) is set as Li1 (not shown). A radiating efficiency and the RL of the multiband antenna 100 can be adjusted by adjusting the lengths Ls1, Lp1, Li1 and the widths Ws1 and Wp1. Table 1 shows values of radiating efficiency and RL of the multiband antenna 100 at different frequencies when Ls1=18 mm, Ws1=1 mm, Wp1=2 mm, Lp1=27 mm, and Li1=13 mm. At these values, the multiband antenna achieves a satisfactory radiating efficiency and sends/receives signals at frequencies of about 2.4 GHz and about 5 GHz.

TABLE 1

Ls1 = 18 mm, Ws1 = 1 mm, Wp1 = 2 mm, Lp1 = 27 mm, Li1 = 13 mm

| | Frequency (MHz) | RL(dB) | Radiating efficiency (%) | Total transmission efficiency (%) |
|---|---|---|---|---|
| 2.4G-Bluetooth/WiFi | 2400 | −15.3 | 70.3 | 68.2 |
| | 2442 | −15.4 | 70.5 | 68.4 |
| | 2484 | −11.3 | 69.8 | 64.6 |
| 5G-WiFi | 5200 | −9.3 | 91.2 | 80.9 |
| | 5400 | −8.7 | 91.7 | 79.6 |
| | 5600 | −8.7 | 91.7 | 79.6 |
| | 5800 | −7.0 | 91.4 | 73.3 |

Figure 5:
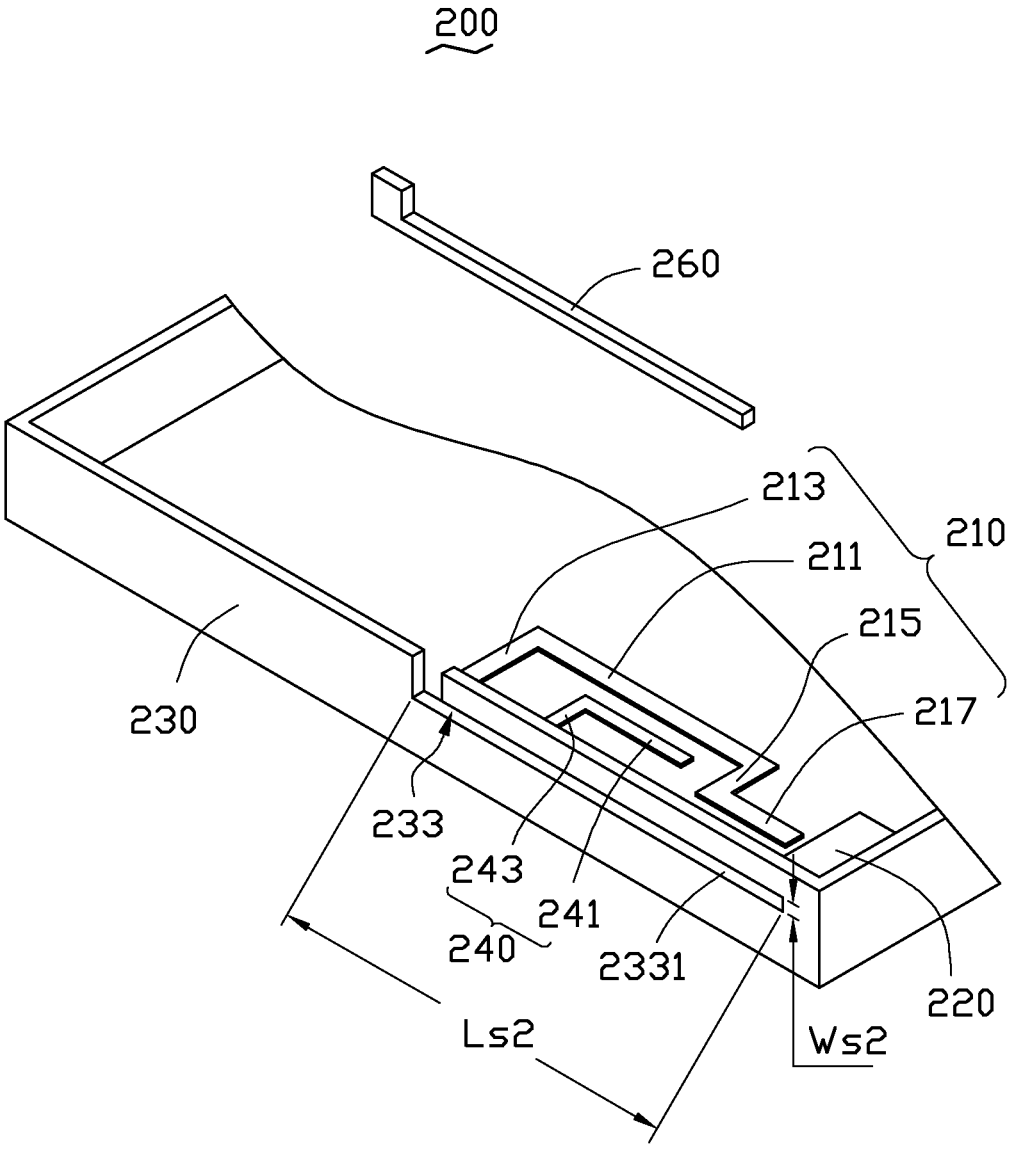
FIG. 5 is a schematic view of a multiband antenna, according to a second exemplary embodiment.

FIG. 5 is a schematic view of a multiband antenna 200, according to a second exemplary embodiment. The multiband antenna 200 includes a radiating portion 210, a grounding portion 220, a metal member 230, a resonating portion 240, and a dielectric member 260. The radiating portion 210 includes a first radiating arm 211, a second radiating arm 213, and a third radiating portion 215. The metal member 230 includes a slit 233, and the slit 233 includes a first sub-slit 2331. The resonating portion 240 includes a fourth radiating arm 241 and a fifth radiating arm 243. The multiband antenna 200 differs from the multiband antenna 100 only in that the radiating portion 210 further includes an extension arm 217, and the grounding portion 220 is a substantially rectangular sheet. The extension arm 217 extends substantially perpendicularly from one end of the third radiating arm 215 opposite to the first radiating arm 211. The first, third, and extension arms 211, 215, and 217 cooperate to form a substantially Z-shaped structure. A distal end of the extension arm 217 is electronically connected to the motherboard of the wireless communication device via a feed cable, to feed signals. The grounding portion 220 is positioned adjacent to a distal end of the extension arm 217, and contacts with the metal member 230.

Figure 6:
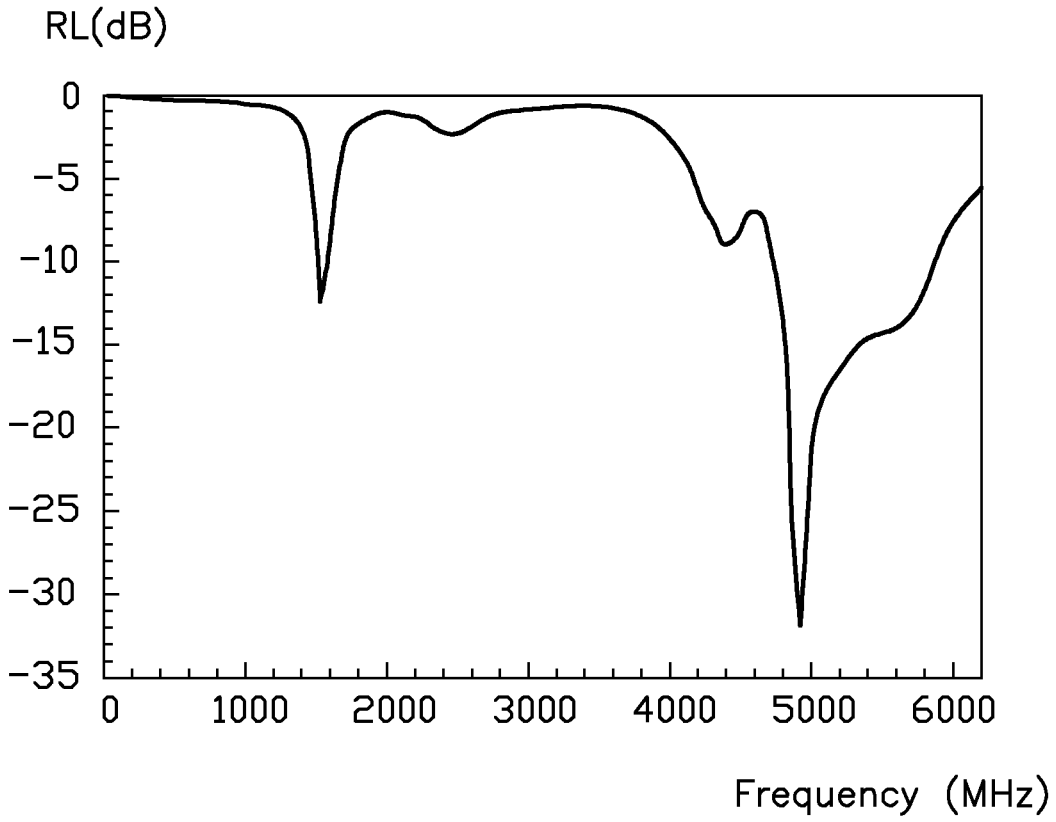
FIG. 6 shows an RL diagram of the multiband antenna of FIG. 5.

FIG. 6 shows an RL diagram of the multiband antenna 200 shown in FIG. 5. The RL of the multiband antenna 200 is less than −6 dB when the multiband antenna 200 receives/sends wireless signals at frequencies of about 1575 MHz and 5200 MHz. Accordingly, the wireless communication device employing the multiband antenna 200 can be used in a plurality of common wireless communication systems, such as GPS and 5.2G-WiFi, with acceptable communication quality.

Figure 7:
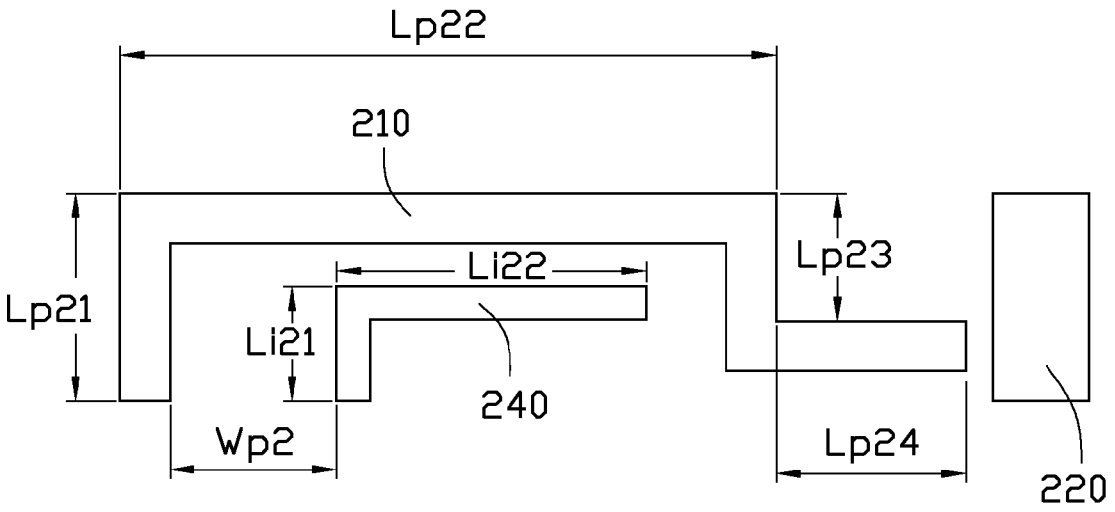
FIG. 7 is a plan view of a radiating portion, a resonating portion, and a grounding portion of the multiband antenna shown in FIG. 5.

FIG. 7 is a plan view of the radiating portion 210, the resonating portion 240, and the grounding portion 220 of the multiband antenna 200 shown in FIG. 5. A length of the first sub-slit 2331 is set as Ls2 (shown in FIG. 5), a width of the first sub-slit 2331 is set as Ws2 (shown in FIG. 5), a length of the radiating portion 210 (that is a sum of a length Lp21 of an outer margin of the second radiating arm 213, a length Lp22 of an outer margin of the first radiating arm 211, and a length Lp23 of an outer margin of the third radiating arm 215) is set as Lp2 (not shown), a distance between the second radiating arm 213 and the fifth radiating arm 243 is set as Wp2, a length of the resonating portion 240 (that is a sum of a length Li21 of an outer margin of the fifth radiating arm 243 and a length Li22 of an outer margin of the fourth radiating arm 241) is set as Li2 (not shown). A radiating efficiency and the RL of the multiband antenna 200 can be regulated by regulating the lengths Ls2, Lp2, Li2 and the widths Ws2 and Wp2. Table 2 shows values of radiating efficiency and RL of the multiband antenna 200 at different frequencies when Ls2=32 mm, Ws2=1 mm, Wp2=5 mm, Lp2=37 mm, and Li2=14 mm. At these values, the multiband antenna achieves a satisfactory radiating efficiency and sends/receives signals at frequencies of about 1575 MHz and about 5200 MHz.

TABLE 2

Ls2 = 32 mm, Ws2 = 1 mm Wp2 = 5 mm Lp2 = 37 mm, Li2 = 14 mm

| | Frequency (MHz) | RL(dB) | Radiating efficiency (%) | Total transmission efficiency (%) |
|---|---|---|---|---|
| GPS | 1575 | −10.5 | 53.1 | 48.3 |
| 5G-WiFi | 5200 | −16.5 | 87.5 | 85.6 |
| | 5400 | −15.0 | 87.3 | 84.6 |
| | 5600 | −14.0 | 86.5 | 83.1 |
| | 5800 | −11.6 | 85.2 | 79.2 |

In each embodiment, the multiband antenna 100 is able to send and receive signals at two different frequencies without the need for a switch or other electrical components to switch the frequencies. Therefore, the disclosure provides a multiband antenna to facilitate miniaturization of electronic devices.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A multiband antenna, comprising:

a radiating portion receiving feed signals and comprising a first radiating arm, a second radiating arm, a third radiating arm, and an extension arm, the second radiating arm perpendicularly connected to one end of the first radiating arm, the third radiating arm perpendicularly connected to the other end of the first radiating arm opposite to the second radiating arm, the extension arm perpendicularly extending from one end of the third radiating arm away from the first radiating arm and opposite to the first radiating arm to be parallel to the first radiating arm, and the first, third, and extension arms cooperate to form a substantially Z-shaped structure;

a grounding portion that is grounded;

a metal member connecting to the radiating portion and the grounding portion, the metal member defining a slit that is adjacent to the radiating portion and the grounding portion, the slit comprising a first sub-slit and a second sub-slit communicating with and perpendicular to the first sub-slit, a distal end of the second radiating arm contacting with the metal member and positioned adjacent to the second sub-slit; and a resonating portion positioned in an area surrounded by the radiating portion and comprising a fourth radiating arm and a fifth radiating arm perpendicular to the fourth radiating arm, the fourth radiating arm parallel to the first radiating arm and the fifth radiating arm parallel to the second radiating arm; the resonating portion connecting to the metal member and spaced apart from the radiating portion; the resonating portion resonating with the radiating portion and the metal member to enable the multiband antenna to receive and send wireless signals at different frequencies.

2. The multiband antenna of claim 1, wherein the radiating portion is coplanar with the resonating portion and the grounding portion.

3. The multiband antenna of claim 1, wherein a distal end of the second radiating arm contacts with the metal member, and a distal end of the extension arm receives feed signals.

4. The multiband antenna of claim 1, wherein the second and third radiating arms are positioned at the same side of the first radiating arm, the third radiating arm is spaced apart from the metal member, the grounding portion is positioned adjacent to a distal end of the extension arm and contacts with the metal member.

5. The multiband antenna of claim 1, wherein the first sub-slit is parallel to the first radiating arm, the second sub-slit is perpendicular to a plane in which the radiating portion is positioned, the radiating portion, the grounding portion and the first sub-slit are positioned at the same side of the second sub-slit.

6. The multiband antenna of claim 5, wherein the metal member comprises a side wall, the slit is defined through the side wall; the side wall comprises two side surfaces and a top surface, the first sub-slit is defined through the two side surfaces, the second sub-slit is defined through the two side surfaces and the top surface.

7. The multiband antenna of claim 1, further comprising a dielectric member, wherein the dielectric member comprises a same shape and size as the shape and size of the slit, the dielectric member fills into the slit.

8. The multiband antenna of claim 1, wherein the metal member is a portion of a housing of a wireless communication device.

9. The multiband antenna of claim 1, wherein the grounding portion is a substantially rectangular sheet.

10. A wireless communication device, comprising:

a metal housing;

a multiband antenna, comprising:

a radiating portion receiving feed signals and comprising a first radiating arm, a second radiating arm, a third radiating arm, and an extension arm, the second radiating arm perpendicularly connected to one end of the first radiating arm, the third radiating arm perpendicularly connected to the other end of the first radiating arm opposite to the second radiating arm, the extension arm perpendicularly extending from one end of the third radiating arm away from the first radiating arm and opposite to the first radiating arm to be parallel to the first radiating arm, and the first, third, and extension arms cooperate to form a substantially Z-shaped structure;

a grounding portion that is grounded;

a metal member that is a portion of the housing, the metal member connecting to the radiating portion and the grounding portion, the metal member defining a slit that is positioned adjacent to the radiating portion and the grounding portion, the slit comprising a first sub-slit and a second sub-slit communicating with and perpendicular to the first sub-slit, a distal end of the second radiating arm contacting with the metal member and positioned adjacent to the second sub-slit; and a resonating portion positioned in an area surrounded by the radiating portion and comprising a fourth radiating arm and a fifth radiating arm perpendicular to the fourth radiating arm, the fourth radiating arm parallel to the first radiating arm and the fifth radiating arm parallel to the second radiating arm, the resonating portion connecting to the metal member and spaced apart from the radiating portion; the resonating portion resonating with the radiating portion and the metal member to enable the multiband antenna to receive and send wireless signals at different frequencies.

11. The wireless communication device of claim 10, wherein the radiating portion is coplanar with the resonating portion and the grounding portion.

12. The wireless communication device of claim 10, wherein a distal end of the second radiating arm contacts with the metal member, and a distal end of the extension arm receives feed signals.

13. The wireless communication device of claim 10, wherein the second and third radiating arms are positioned at the same side of the first radiating arm, the third radiating arm is spaced apart from the metal member, the grounding portion is positioned adjacent to a distal end of the extension arm and contacts with the metal member.

14. The wireless communication device of claim 10, wherein the first sub-slit is parallel to the first radiating arm, the second sub-slit is perpendicular to a plane in which the radiating portion is positioned, the radiating portion, the grounding portion and the first sub-slit are positioned at the same side of the second sub-slit.

15. The wireless communication device of claim 14, wherein the metal member comprises a side wall, the slit is defined through the side wall; the side wall comprises two side surfaces and a top surface, the first sub-slit is defined through the two side surfaces, the second sub-slit is defined through the two side surfaces and the top surface.

16. The wireless communication device of claim 10, wherein the multiband antenna further comprises a dielectric member, wherein the dielectric member comprises a same shape and size as the shape and size of the slit, the dielectric member fills into the slit.

17. The wireless communication device of claim 10, wherein the grounding portion is a substantially rectangular sheet.

* * * * *